US006402525B2

(12) United States Patent
Gugliotti et al.

(10) Patent No.: US 6,402,525 B2
(45) Date of Patent: Jun. 11, 2002

(54) POWER CONNECTOR FOR CONNECTION TO A PRINTED CIRCUIT BOARD

(75) Inventors: Carmine Gugliotti, Waterbury, CT (US); George W. Brehm, Holmes; Bruce E. Moore, Poughkeepsie, both of NY (US)

(73) Assignee: Northrop Grumman Corporation, Los Angeles, CA (US)

( * ) Notice: Subject to any disclaimer, the term of this patent is extended or adjusted under 35 U.S.C. 154(b) by 0 days.

(21) Appl. No.: 09/858,547

(22) Filed: May 17, 2001

Related U.S. Application Data

(60) Provisional application No. 60/205,253, filed on May 19, 2000.

(51) Int. Cl.[7] ..... H01R 12/00
(52) U.S. Cl. ..... 439/65; 439/62; 439/853
(58) Field of Search ..... 439/62, 63, 65, 439/86, 786, 851, 853, 843, 74, 78, 59

(56) References Cited

U.S. PATENT DOCUMENTS 4,017,143 A 4/1977 Knowles ..... 339/221
4,557,548 A * 12/1985 Thrush ..... 339/258
5,421,751 A * 6/1995 Bennett et al. ..... 439/843
5,842,876 A 12/1998 Collin et al. ..... 439/78
6,210,240 B1 * 4/2001 Comerci et al.

* cited by examiner

*Primary Examiner*—P. Austin Bradley
*Assistant Examiner*—Alexander Gilman
(74) *Attorney, Agent, or Firm*—Lowe Hauptman Gilman & Berner, LLP

(57) ABSTRACT

The present invention is directed to an electrical power connector including a U-shaped body including a first wall with a first plurality of undercut grooves and a second wall that has a second plurality of undercut grooves and a base member that has a third plurality of rectangular slots. A first plurality of spring contacts are each positioned in a corresponding one of the first plurality of grooves. A second plurality of spring contacts are each positioned in a corresponding one of the second plurality of grooves. A third plurality of carrier mounted pins are each positioned in a corresponding one of the plurality of rectangular slots.

22 Claims, 2 Drawing Sheets

POWER CONNECTOR FOR CONNECTION TO A PRINTED CIRCUIT BOARD

RELATED APPLICATION

The present application claims priority of U.S. Provisional Application Ser. No. 60/205,253, filed May 19, 2000, entitled "POWER CONNECTOR FOR CONNECTION TO A PRINTED CIRCUIT BOARD", the disclosure of which is incorporated by reference herein in its entirety.

FIELD OF THE INVENTION

The present invention relates generally to electrical connectors, and more particularly, electrical power connectors capable of carrying high current from 50 amps to 1000 amps at low voltages from 0.5 volts to 48 volts.

BACKGROUND OF THE INVENTION

Electrical power connectors are often needed to carry high current between one circuit board and another circuit board. Electrical backplanes frequently have multiple daughtercards connected to the backplane which require both signal and power connectors to make electrical connections between the backplane and daughtercard. For example, a need exists in the art for a connector capable of carrying several currents between 125 amps to 950 amps at 1.5 volts, 1.8 volts and 2.5 volts.

Electrical backplanes frequently are populated with multiple daughtercards. The daughtercards are connected to the backplanes using electrical connectors known in the art. From time to time it becomes desirable or necessary to change daughtercards to either change the configuration of the electrical circuit contained on the daughtercard or to replace defective daughtercards. The prior art does not adequately address a simple means for providing high current power at low voltages to the daughtercard from power supplies contained on the backplane. In addition, it would be desirable to have an electrical connector for providing power to a daughtercard from a backplane in which the power connection between the backplane and the daughtercard is effected simultaneously with inserting the daughtercard into the electrical connector which transfers electrical signals between the backplane and daughtercard.

SUMMARY OF THE INVENTION

It is, therefore, an object of the present invention to provide a U-shaped electrical power connector.

It is, therefore, an object of the present invention to provide an electrical power connector capable of carrying high current from 50 amps to 1000 amps at low voltages from 0.5 volts to 48 volts.

Another object of the present invention is to provide an electrical conductor using a plurality of leaf springs or cantilever springs for carrying current between a male and female connector.

Yet another object of the present invention is to provide an electrical power connector for providing power from an electrical backplane to one or more daughtercards mounted on the backplane.

These and other objects of the present invention are achieved by an electrical power connector including a U-shaped body including a first wall with a first plurality of undercut grooves and a second wall that has a second plurality of undercut grooves and a base member that has a third plurality of rectangular slots. A first plurality of spring contacts are each positioned in a corresponding one of the first plurality of grooves. A second plurality of spring contacts are each positioned in a corresponding one of the second plurality of grooves. A third plurality of carrier mounted pins are each positioned in a corresponding one of the plurality of rectangular slots.

Still other objects and advantages of the present invention will become readily apparent to those skilled in the art from the following detailed description, wherein the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawings and description thereof are to be regarded as illustrative in nature, and not as restrictive.

BRIEF DESCRIPTION OF THE DRAWINGS

The present invention is illustrated by way of example, and not by limitation, in the figures of the accompanying drawings, wherein elements having the same reference numeral designations represent like elements throughout and wherein.

BEST MODE FOR CARRYING OUT THE INVENTION

Figure 1:
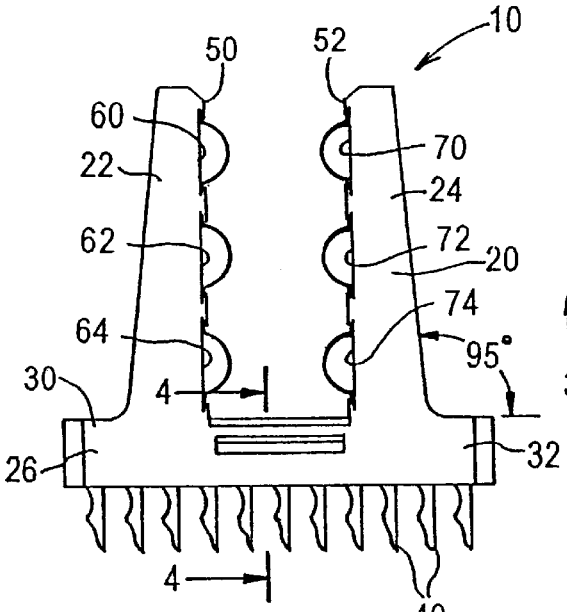
FIG. 1 is a side elevational view of an electrical power connector according to the present invention.
Figure 2:
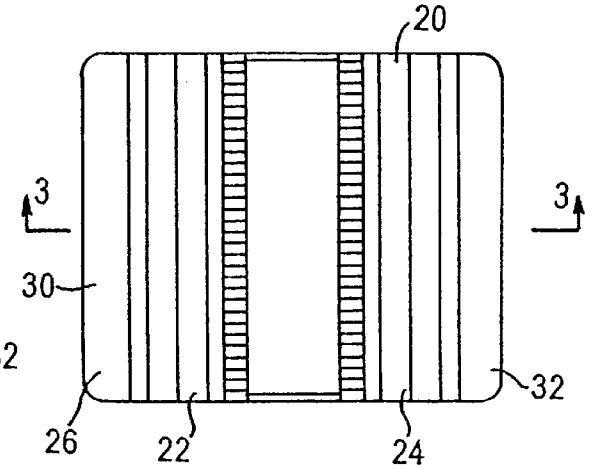
FIG. 2 is a top plan view of an electrical power connector according to the present invention.
Figure 3:
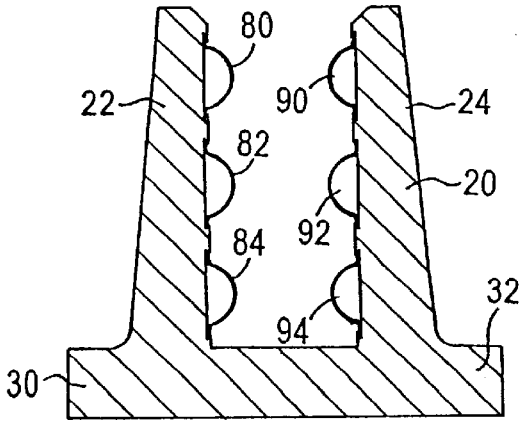
FIG. 3 is a cross-sectional view taken along lines 3—3 in FIG. 2.

Refer now to FIG. 1 where a side elevational view of an electrical power connector 10 according to the present invention is depicted. As illustrated, the electrical power connector 10 is depicted in an upright orientation although it should be understood that the electrical power connector 10 is usable in any orientation. Accordingly, terms used herein such as "left", "right", "above" and "below" should be construed in a relative sense.

The electrical power connector 10 includes a generally U-shaped body 20 having a first upwardly extending wall 22 and a second upwardly extending wall 24. The body can be made from a high conductivity material, for example, brass, copper, aluminum, or a copper alloy material. The body 20, in one embodiment, is of a unitary construction. In this embodiment, two electrical power connectors 10 would be required with one connector being a positive terminal and the other connector being a negative terminal. A base member 26 connects walls 22 and 24. In addition, the length and width of the base member 26 can be varied depending upon the amount of power to be transferred between the backplane and daughtercard and the space requirements. The height of the walls 22, 24 of the connector 10 can be varied to facilitate mechanical connection of the daughtercard to the backplane. The base member 26 also has outwardly extending shoulders 30, 32. A plurality of pins 40 extend downwardly from a lower surface of base member 26. The C-Press pins 40 which may be used to mount the connector to the backplane are described in U.S. Pat. No. 4,017,143, issued Apr. 12, 1977 and a power connector using such pins is described in U.S. Pat. No. 5,842,876, issued Dec. 1, 1998, both of which are hereby incorporated by reference in their entirety into this specification. A row of pins 40 are stamped from a unitary piece of metal. The pins 40 are connected to each other by a common carrier (not shown). The carrier is inserted into a groove machined into the bottom surface of the base member 26. A staking process is used to mechanically fasten the carrier and the pins 40 to the base member 26. A soldering, brazing or other mechanical fastening process can be used. The walls 22 and 24 each have an inner surface 50, 52, respectively, each having a plurality of opposed undercut horizontal grooves extending for the entire length of walls 22, 24, as depicted in FIG. 1. As depicted, wall 50 has undercut grooves 60, 62, 64 and surface 52 has undercut grooves 70, 72, 74. The undercut grooves 60, 62, 64 and 70, 72, 74 do not have to extend for the entire length of the walls 22, 24, respectively. For example, the grooves 60, 62, 64 and 70, 72, 74 can stop short of the end of one wall to provide a positive stop to help to retain the springs to the walls. Although leaf springs are shown, other types of contacts can be used, for example, a cantilevered contact having a free end to make contact with the mating daughtercard connector.

The connector 10 operates by making contact with conductive surfaces on the daughtercard inserted into it. For example, copper surfaces can be laminated onto one or both sides of the daughtercard to facilitate making a power connection between the backplane and the daughtercard. Note that both sides of the daughtercard do not have to have conductive surfaces, depending on how much power is to be transferred between the backplane and the daughtercard. Also note that the top portions of the walls 22 and 24 taper inwardly to guide a daughtercard into the aperture within the power connector when the daughtercard is being inserted into the connector. It is also possible to have an insulating cover over the connector to prevent accidental electrocution. The cover would fit over the entire connector except, however, that it would have a slot along the top and side edges to accommodate entry of a daughtercard. One end of the insulator could be closed if the power connector was placed in a position such that it made contact with power contacts on a far end of a daughtercard. A plurality of contact springs are retained in the undercut grooves 60–64 and 70–74.

The daughtercard (not shown) is inserted into the U-shaped area making contact to the springs.

Figure 4:
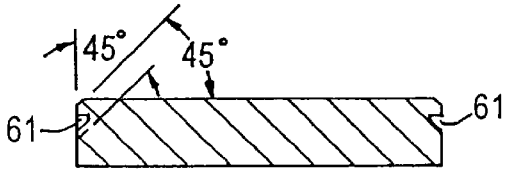
FIG. 4 is a cross-sectional view taken along lines 4—4 in FIG. 1.
Figure 4A:
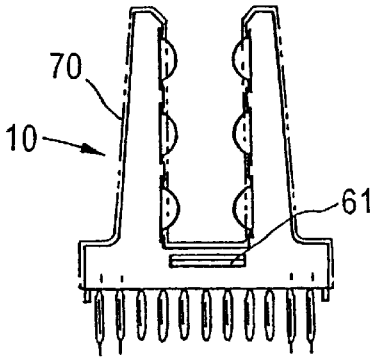
FIG. 4A is a side elevational view of the electrical power connector with an electrically insulative cover.

As depicted in FIG. 4, an undercut 61 is required to accept a latch from an electrically insulating sheath 70 (see FIG. 4A) for retention of the sheath 70. The sheath 70 is shaped so as to conform to the exterior surfaces of the U-shaped body 20. The sheath 70 can be formed of a glass filled thermoplastic polyester.

The power handling capability of the power connector can be modified by changing either the number of pins on the backplane and daughtercard sides of the power connector and/or the size of the pins and the plated through-holes on the backplane and daughtercard into which the pins are inserted. Also the wide and length of the base member 24 and corresponding daughtercard portion 112 can be sized to accommodate different numbers of pins and contacts and voltages and currents. The pins can either be placed in the backplane and daughtercard by friction fit into plate through-holes in the respective boards and/or can be soldered in place to effect a secure mechanical and electrical connection between circuits on the backplane and daughtercard through respective power connector portions.

Figures 5A, 5B:
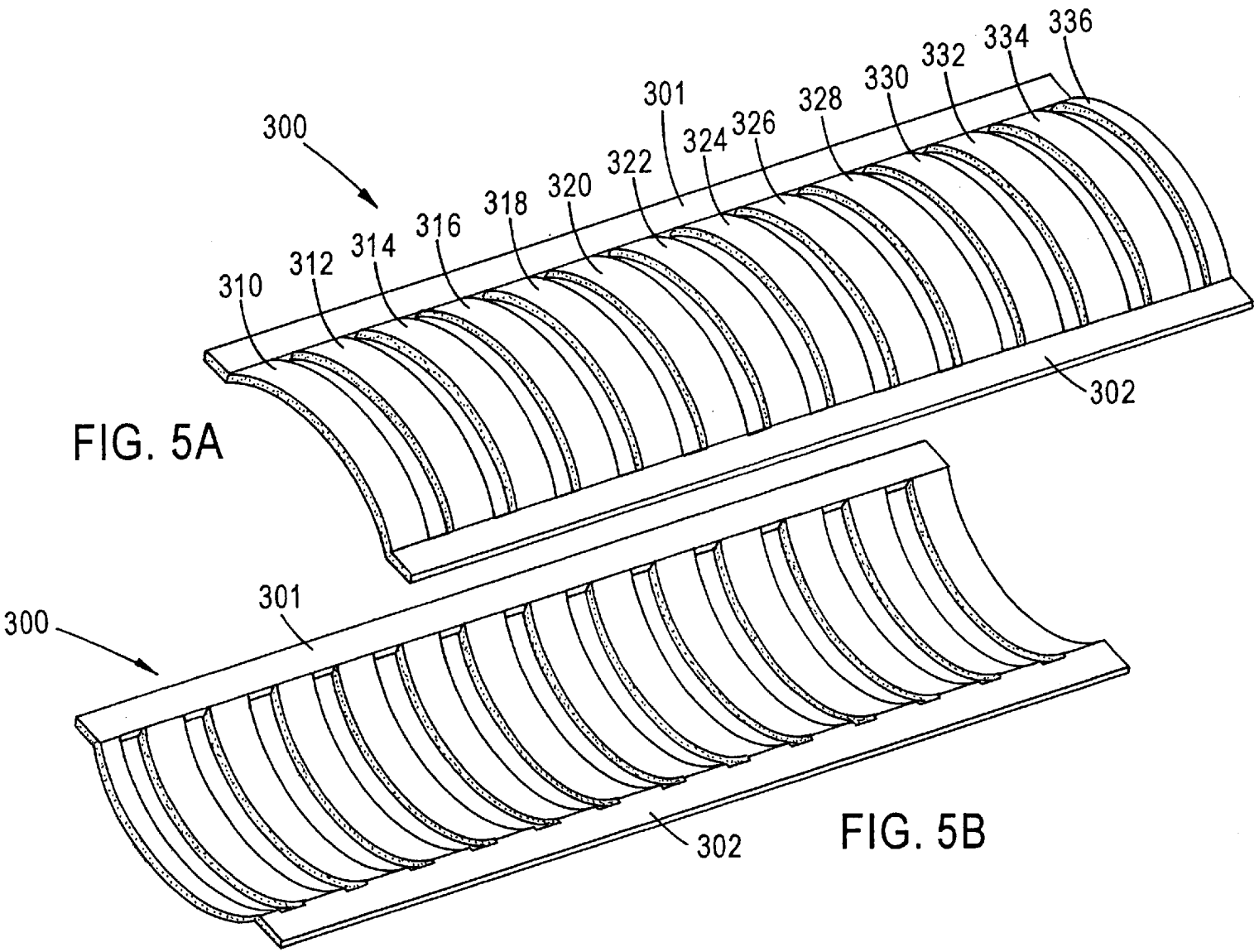
FIGS. 5A and 5B are top and bottom perspective views of a spring contact according to the present invention.

FIGS. 5A and 5B depict a contact spring 300 according to the present invention. The contact spring 300 is illustrative of the contact springs 80–94 discussed above. The contact springs are preferably formed from beryllium copper or equivalent material with the appropriate mechanical and electrical properties and can be stamped in a progressive die. The contact spring 300 has a pair of opposed longitudinal sections 301, 302. Joining the longitudinal sections are a plurality of spaced apart curved members 310, 336 which extend transversely relative to the longitudinal sections 300, 302. The longitudinal sections are retained in opposite undercut portions of the undercut grooves. Each of these flexible spring contacts 310, 336 forms an electrical contact point between the male connector and the female connector. One benefit of the power connector design utilizing multiple spring fingers of the type shown is to effect a tight electrical and mechanical connection between the two power connector portions even though slight misalignment may occur between the backplane and daughtercard.

It should be appreciated that the electrical power connector shown and described can assist in providing physical mounting rigidity between the backplane and daughtercards and that multiple power connectors can be used for one or more daughtercards mounted on a backplane depending on the amount of power required for the daughtercard and to assist in providing mechanical rigidity between the backplane and daughtercard.

It will be readily seen by one of ordinary skill in the art that the present invention fulfills all of the objects set forth above. After reading the foregoing specification, one of ordinary skill will be able to affect various changes, substitutions of equivalents and various other aspects of the invention as broadly disclosed herein. It is therefore intended that the protection granted hereon be limited only by the definition contained in the appended claims and equivalents thereof.

What is claimed is:

1. A power connector for receiving a printed circuit board, comprising:

a relatively rigid U-shaped body including a first wall with a first plurality of undercut grooves spaced from each other in a mating direction and a second wall having a second plurality of undercut grooves spaced from each other in a mating direction and a third wall having a third plurality of rectangular slots;

a first plurality of rows of spring contacts, each row positioned in a corresponding one of said first plurality of grooves and being spaced from other ones of said plurality of rows of spring contacts;

a second plurality of rows of spring contacts, each row positioned in a corresponding one of said second plurality of grooves and being spaced from other ones of said plurality of rows of spring contacts; and a third plurality of pins each positioned in a corresponding one of said third plurality of rectangular slots;

wherein the printed circuit board is retained and supported by said power connector and is in electrical contact with said first and second plurality of and second plurality of rows of spring contacts.

2. The power connector of claim 1, wherein said first and second plurality of rows of spring contacts are engageable with a daughtercard and said third plurality of pins is engageable with a back plane connector.

3. The power connector of claim 1, further comprising an insulating member positioned in said third wall for electrically separating said first wall and said second wall.

4. The power connector of claim 1, wherein said U-shaped body is formed of a single electrically conductive material.

5. The power connector of claim 1, wherein each of said spring contacts extends inwardly beyond said undercut groove.

6. The power connector of claim 1, wherein said first wall and said second wall are parallel to each other.

7. The power connector of claim 1, wherein 400 A/square inch is carried by said power connector.

8. The power connector of claim 1, wherein said grooves are located on inner surfaces of said first wall and said second wall.

9. The power connector of claim 1, wherein said first plurality of rows of spring contacts are vertically spaced from each other and said second plurality of rows of spring contacts are vertically spaced from each other.

10. The power connector of claim 1, wherein said undercut grooves extend horizontally.

11. The power connector of claim 1, wherein each of said spring contacts is louvered spring.

12. The power connector of claim 1, wherein said third plurality of pins are connected to each other.

13. The power connector of claim 1, wherein each of said spring contacts is formed from beryllium copper.

14. The power connector of claim 1, further comprising an electrically insulating sheath covering the exterior surfaces of said U-shaped body.

15. The power connector of claim 1, wherein said first and second plurality of rows of spring contacts extend horizontally.

16. The power connector of claim 1, wherein each of said spring contacts has opposed straight sections and a plurality of curved sections connecting said opposed straight sections.

17. The power connector of claim 16, wherein each of said curved sections forms a contact point with a hollow conductor connected to a daughtercard.

18. The power connector of claim 16, wherein said curved sections extend in a direction parallel to said first wall and said second wall.

19. The power connector of claim 16, wherein said first and second plurality of rows of spring contacts extend horizontally and said curved sections extend vertically.

20. A power connector, comprising:

a U-shaped body formed of a single electrically conductive material including a first wall with a first plurality of undercut grooves spaced from each other in a mating direction and a second wall having a second plurality of undercut grooves spaced from each other in a mating direction and a third wall having a third plurality of rectangular slots;

a first plurality of rows of spring contacts, each row positioned in a corresponding one of said first plurality of grooves and being spaced from other ones of said plurality of rows of spring contacts;

a second plurality of rows of spring contacts, each row positioned in a corresponding one of said second plurality of grooves and being spaced from other ones of said plurality of rows of spring contacts; and a third party of pins each positioned in a corresponding one of said third plurality of rectangular slots.

21. The power connector of claim 20, wherein said power connector receives one of a blade and a printed circuit board.

22. A power connector for receiving a printed circuit board, comprising:

a relatively rigid U-shaped body formed of a single electrically conductive material including a first wall with a first plurality of undercut grooves spaced from each other in a mating direction and a second wall having a second plurality of undercut grooves spaced from each other in a mating direction and a third wall having a third plurality of rectangular slots;

a first plurality of rows of spring contacts, each row positioned in a corresponding one of said first plurality of grooves and being spaced from other ones of said plurality of rows of spring contacts;

a second plurality of rows of spring contacts, each row positioned in a corresponding one of said second plurality of grooves and being spaced from other ones of said plurality of rows of spring contacts; and a third plurality of pins each positioned in a corresponding one of said third plurality of rectangular slots;

wherein the printed circuit board is retained by said power connector and is in electrical contact with said first and second plurality of rows of spring contacts.

* * * * *

UNITED STATES PATENT AND TRADEMARK OFFICE

CERTIFICATE OF CORRECTION

PATENT NO. : 6,402,525 B2 
DATED : June 11, 2002
INVENTOR(S) : Carmine Gugliotti, George W. Brehm and Bruce E. Moore It is certified that error appears in the above-identified patent and that said Letters Patent is hereby corrected as shown below:

Title page,
Item [73], Assignee, please replace "Northrop Grumman Corporation, Los Angeles, CA (US)" with -- Litton Systems, Inc., Los Angeles, California, (US) --.

Signed and Sealed this

Second Day of September, 2003

JAMES E. ROGAN
*Director of the United States Patent and Trademark Office*